US011511204B2

(12) United States Patent
Jacobi et al.

(10) Patent No.: US 11,511,204 B2
(45) Date of Patent: Nov. 29, 2022

(54) AMUSEMENT DEVICE

(71) Applicant: ANTONIO ZAMPERLA S.p.A., Altavilla Vicentina VI (IT)

(72) Inventors: Timothy Robert Jacobi, Altavilla Vicentina VI (IT); Alberto Zamperla, Altavilla Vicentina VI (IT)

(73) Assignee: ANTONIO ZAMPERLA S.p.A., Altavilla Vicentina VI (IT)

( * ) Notice: Subject to any disclaimer, the term of this patent is extended or adjusted under 35 U.S.C. 154(b) by 0 days.

(21) Appl. No.: 17/290,388

(22) PCT Filed: Nov. 8, 2019

(86) PCT No.: PCT/EP2019/080720
§ 371 (c)(1),
(2) Date: Apr. 30, 2021

(87) PCT Pub. No.: WO2020/094854
PCT Pub. Date: May 14, 2020

(65) Prior Publication Data

US 2021/0402311 A1 Dec. 30, 2021

(30) Foreign Application Priority Data

Nov. 9, 2018 (EP) ..... 18205541

(51) Int. Cl.
*A63G 27/08* (2006.01)
*A63G 27/02* (2006.01)
*A63G 1/08* (2006.01)

(52) U.S. Cl.
CPC ..... *A63G 27/02* (2013.01); *A63G 27/08* (2013.01)

(58) Field of Classification Search
CPC ... A63G 1/00; A63G 1/10; A63G 1/02; A63G 1/36; A63G 27/08
USPC ..... 472/39, 47
See application file for complete search history.

(56) References Cited

U.S. PATENT DOCUMENTS

| | | | | |
|---|---|---|---|---|
| 2,255,175 | A | 9/1941 | Lorow | |
| 8,926,440 | B2 * | 1/2015 | Jacobi | A63G 31/00 472/30 |
| 2006/0035715 | A1 * | 2/2006 | Threlkel | A63G 27/04 472/47 |
| 2008/0113822 | A1 * | 5/2008 | Kitchen | A63G 1/34 472/43 |

FOREIGN PATENT DOCUMENTS

| | | |
|---|---|---|
| CN | 102814044 | 12/2012 |
| DE | 288244 | 3/1909 |
| GB | 17873 | 2/1908 |
| GB | 238809 | 8/1925 |

OTHER PUBLICATIONS

International Search report and written opinion issued by the EPO dated Dec. 5, 2019 for PCT/EP2019/080720.
Office Action issued by the CN patent office for corresponding CN application No. 201980009196.1 dated Apr. 14, 2021.

* cited by examiner

*Primary Examiner* — Kien T Nguyen
(74) *Attorney, Agent, or Firm* — Silvia Salvadori

(57) ABSTRACT

An amusement device (1) with a central shaft (2) which includes a base structure (2a); and a plurality of arms (3a, 3b, 3c, 3d), coupled to the central shaft (2), each of the arms (3a-3d) being rotatable around a relevant arm axis (A2), provided with one or more vehicles (6) having seats for users of the amusement device (1).

25 Claims, 10 Drawing Sheets

AMUSEMENT DEVICE

This application is a U.S. national stage of PCT/EP2019/080720 filed on 8 Nov. 2019 which claims priority to and the benefit of European Application No. 18205541.8 filed on 9 Nov. 2018 the contents of which are incorporated herein by reference in their entireties.

FIELD OF THE INVENTION

The present invention relates to an amusement device. In particular, the amusement device according to the invention is used, for example, in funfairs and theme parks, and in particular is an amusement device, comprising a plurality of seats that are mounted in a movable manner with respect to a central shaft.

BACKGROUND OF THE INVENTION

Different amusement device, provided with seats that are moved around a central shaft are known in the art.

As an example, carousels are known, where a plurality of seats are mounted in a rotatable manner around a central shaft. The users of the amusement device are thus moved around a circular path. The experience of the user is thus repetitive over time. Some modifications have been devised to enhance the experience of carousels, e.g. the seats may be also movable in a vertical manner with respect to the shaft. The experience of the user is somewhat more diversified, but still repetitive, e.g. a first user is always looking toward a second user.

It has been proposed to provide the user with visors, to let them experience a virtual reality during the ride. Such a solution provides an improved experience, but it is complex and expensive.

Amusement devices where the users are mainly moved along a vertical direction are also known (the so called "towers"). In these amusement devices, the user are lifted and then suddenly and rapidly lowered, to provide a feeling of a fall. These amusement devices provide thrill and excitement to the user, but these feeling are mainly provided by the fall, i.e. by a short amount of time.

GB190717873 discloses an amusement device comprising a revolving support and a plurality of arms, rotatable around shafts arranged at right angles one with respect to the other, and mounted orthogonally with respect to the revolving support. A motor is placed at the bottom of the revolving support, to control rotation of the revolving support. The shafts that support the arms are integral in rotation with the revolving support, and are provided with bevel gears, that mesh with a central fixed wheel gear so that, when the shafts of the arms rotate integral with the revolving support, the shafts are also rotated around their longitudinal axes, and opposite arms are rotated in opposite directions.

This solution provide a somewhat greater thrill, but it is still provided with some drawbacks, e.g. it is complex to produce, it has a rotating gear at the ground level (that may harm the users or passengers) and, during operation, causes the rotation of a great structure (i.e. the revolving support), so that it needs a great amount of energy to operate, due to the inertia of such a structure.

An object of the present invention is thus to provide an amusement device, providing a durable thrill and amusement to the user.

Another object of the present invention is to provide such an amusement device, in a simple and reliable manner.

A further object of the present invention is to provide such an amusement device, providing a safe experience to the user.

SUMMARY OF THE INVENTION

These and other objects are achieved by the present amusement device according to one or more of the appended claims. The present solution provides an amusement device according to claim 1. Additional features/aspects are presented in the dependent claims.

The amusement device according to the invention comprises:

- a central shaft comprising a base structure;
- a plurality of arms, coupled to the central shaft, each of the arms being rotatable around a relevant arm axis, provided with one or more vehicles having seats for users of the amusement device, preferably arranged at both the ends of the arms;
- a gear system for rotating the plurality of arms, the gear system comprising:
  - a gear motor coupled to a first gear, to rotate the first gear;
  - a plurality of second gears, one for each arm of the plurality of arm, coupled to the first gear so that rotation of the first gear drives in rotation the second gears, the rotation of the second gears causing rotation of each arm around the relevant arm axis.

The gear system is configured so that the angular speed (i.e. the magnitude of the angular velocity) of the arms is substantially identical for all the arms, and the first gear is directly meshing with the second gears, or it is coupled to the second gear via one or more secondary gears.

The first and second gears mesh directly, or via other gears, so that they can be placed with freedom in the amusement device. As a result, production and mounting of the amusement device is simple. Thanks to the present solution, the rotation of the arms can be operated independently from the rotation of the central shaft, thus providing energy saving, and also allowing to use motors of smaller dimension.

Preferably, the arms are arranged substantially perpendicularly with respect to the central shaft. More in general, considering the shaft axis (i.e. the longitudinal axis of the central shaft), the arm axes are distinct from the shaft axis.

According to a possible aspect, the central shaft comprises one or more movable portions, that are movable with respect to the base structure.

In particular, the central shaft comprises a portion that is rotatable with respect to the base structure, preferably by means of a shaft motor which is distinct from the gear motor.

According to a further aspect, the central shaft comprises a portion that is translatable with respect to the base structure, along a longitudinal axis of the central shaft.

Advantageously, having a portion that is translatable with respect to the base structure allows easy loading/unloading operation of the users on the vehicles, as a plurality of vehicles can be contemporarily placed at the ground level (or at the level needed to allow embarking of the users). In fact, in an exemplary embodiment of an amusement device according to the invention, the movable portion can be moved so that the vehicles of different arms come close to the ground (or to a platform allowing embarking and disembarking of the users) at the same time.

According to an aspect, the gear motor, the first gear and the second gears are mounted on one of the movable portions of the shaft. As an example, they can be mounted substantially at the top of the central shaft, so that they are distanced from the users, and from the arms. Also, the space occupied by the amusement device is reduced (in particular the footprint of the amusement device), as the motor is not placed laterally with respect to the central shaft.

According to an aspect the amusement device is configured so that for each arm, the path of one of the ends of the arm intersects the path of at least one end of another arm, and the gear system is configured to avoid collisions of the arms.

Advantageously, this provides entertainment to the user, which has the feeling that the vehicle of an arm (and in particular the vehicle on which he/she is seated) is going to collide with another vehicle of a different arm of the amusement device.

Also, during operation of the amusement device, the users are brought (in different times) near different vehicles, so that they visually interact with different users of the amusement device over time.

According to an aspect, the first gear is rotatable around a first gear axis and the second gears are rotatable around second gears axes, the first gear axis being perpendicular with respect to the second gear axes.

According to a further aspect, each of the second gears is coupled to a second gear shaft, the arms being coupled to the second gear shafts, or to arm shafts that is driven in rotation by, and parallel to, the gear shaft.

In a preferred embodiment, the amusement device according to the invention has an even number of arms, preferably four arms, so that a pair of opposite arms rotates around the same arm axis, along opposite direction, i.e. in a counterwise manner. According to an aspect, a first reduction stage is interposed between the gear motor and the first gear.

Furthermore, a second reduction stage can be interposed between the second gears and the relevant arms;

According to further aspect each arm is provided with a safety gear, configured so that:

- when each arm is driven by the gear motor, the safety gear of an arm is disengaged from the safety gears of the other arms,
- when there is a failure, and at least one of the arms is not driven by the gear motor, the safety gear of an arm that is not driven by the gear motor couples with at least one safety gear of another arm.

The safety gears assure synchronization of the arms, even if one or more of the first/second gears is damaged, thus improving the safety of the users of the amusement device.

Preferably, the safety gears are provided with teeth that are arranged so that, in normal condition, the teeth of the safety gears do not mesh, while, in case of a failure, the teeth of a safety gear meshes with the teeth of at least one different safety gear, so that the latter may drive the former.

An aspect of the present invention also relates to a method of operation of an amusement device according to one or more of the preceding aspects, wherein the arms are rotated via the gear motor, and at least one movable portion of the central shaft is moved with respect to the base structure of the central shaft.

According to an aspect, the at least one movable portion comprises or consists of a translatable portion, that is translated with respect to said base structure.

In addition, or as an alternative solution, the at least one movable portion comprises or consists of a rotatable portion, that is rotated with respect to the base structure, preferably via a shaft motor operated independently from the gear motor.

A further aspect of the present invention relates to a method of operation of an amusement device according to one or more of the above discussed aspects, wherein each arm is provided with a safety gear, and when each of said arm is driven by the gear motor, the safety gear of an arm is disengaged from the safety gears of the other arms, and when there is a failure, and at least one of the arms is not driven by the gear motor, the safety gear of an arm that is not driven by the gear motor couples with the teeth of at least one safety gear of another arm.

DESCRIPTION OF THE FIGURES

One or more embodiments of the present invention are now described in greater detail with reference to the accompanying drawings provided by way of non-limiting example, wherein.

DETAILED DESCRIPTION OF THE INVENTION

Figure 1:
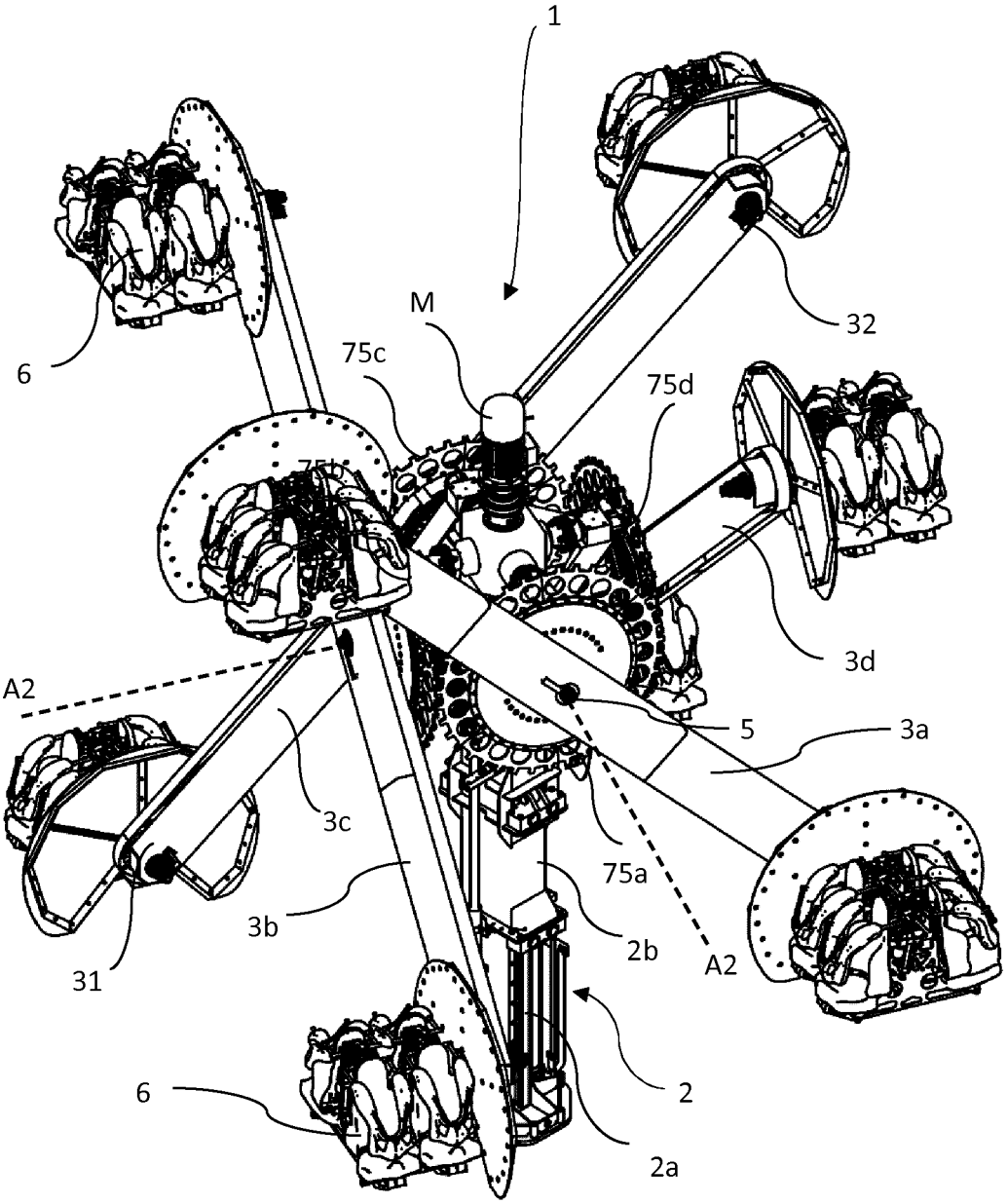
FIG. 1 is a perspective view of an embodiment of an amusement device according to the invention during its operation.
Figure 2:
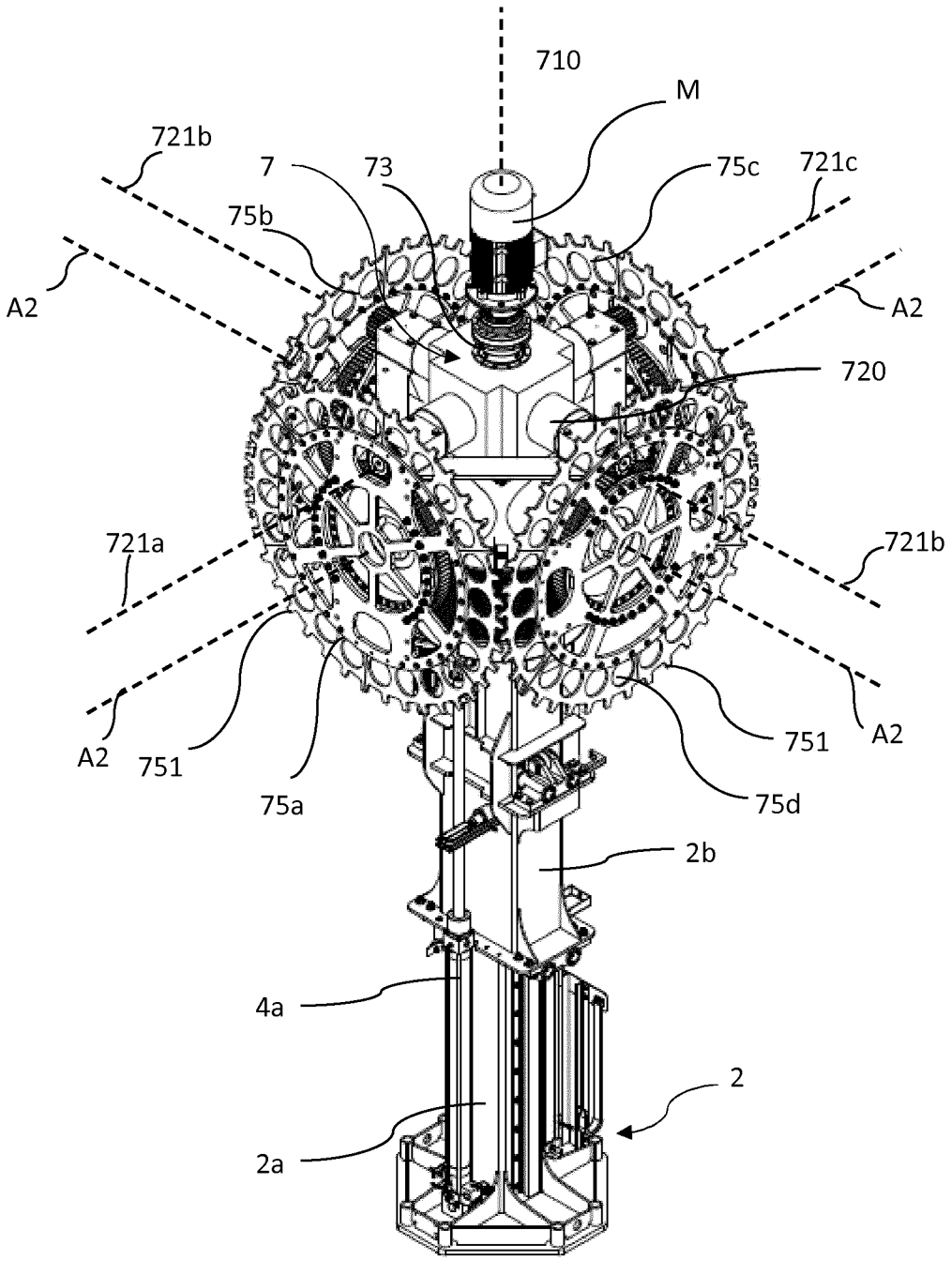
FIG. 2 is a perspective view of the amusement device of FIG. 1, shown without arms mounted.
Figure 3:
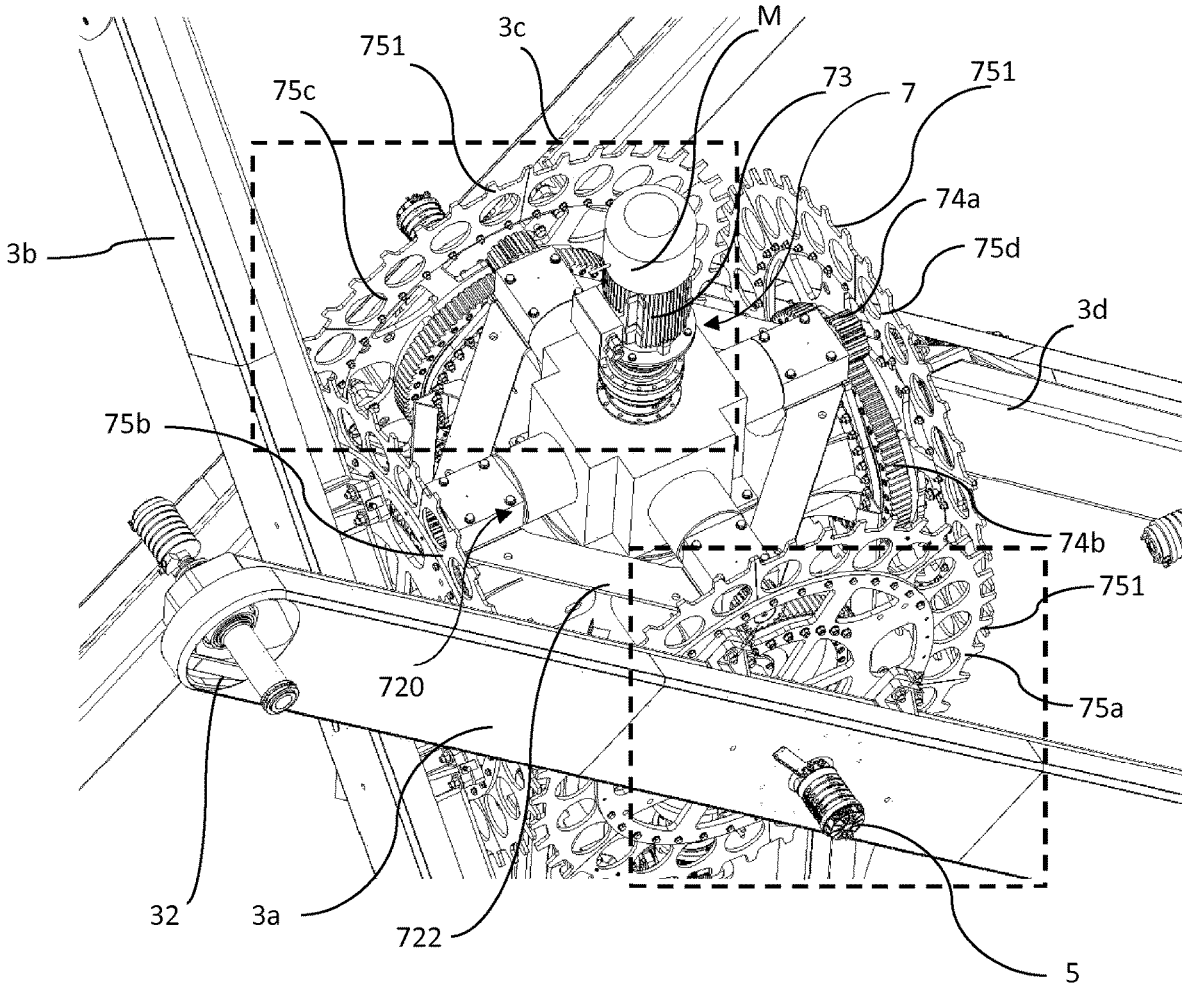
FIG. 3 is a perspective top view of the amusement device of FIG. 1, showing the relevant gear system
Figure 3A:
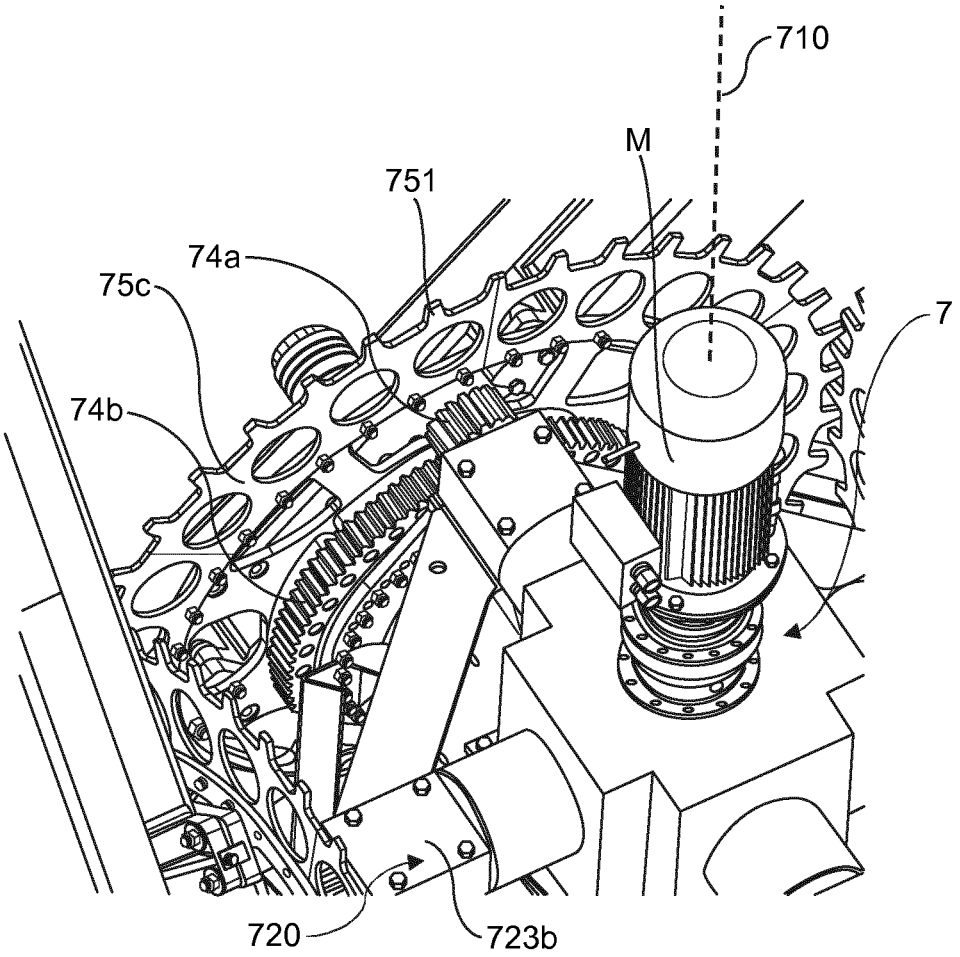
FIGS. 3A and 3B are enlarged views of the gear system and reduction stages shown in FIG. 3.
Figure 3B:
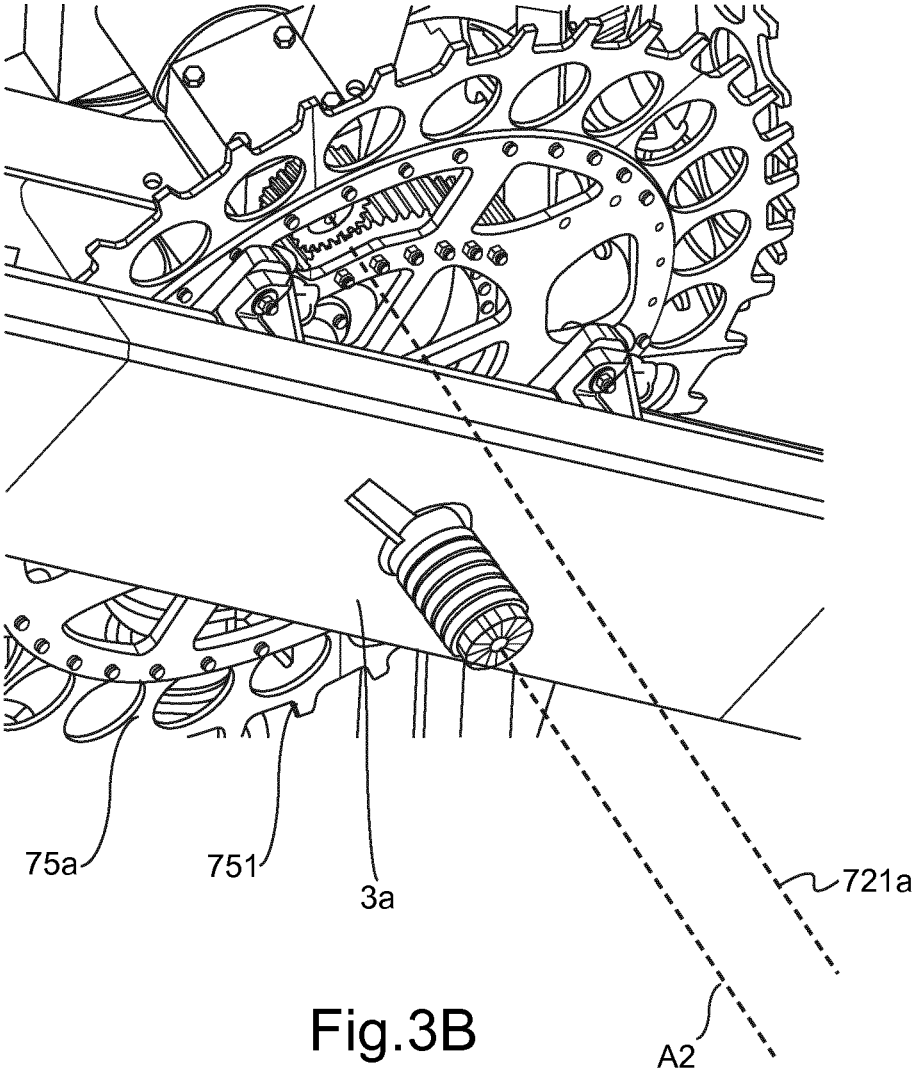

With reference to figures, the amusement device 1 comprises a central shaft 2, comprising a base structure 2*a* that, in use, is generally placed on the ground or, more in general, coupled to (or leaned on) an external surface.

The central shaft 2 has a longitudinal axis A1 that is typically vertical during use.

Preferably, the central shaft 2 comprises one or more portions 2*b*, 2*c* that are movable with respect to the base structure 2*a*. As an example, the portions 2*b*, 2*c* may be coupled in a nested tube arrangement, i.e. telescopically, with respect to the base structure 2*a*. In a preferred embodiment, shown in the figures, a first portion 2*b* of the central shaft 2 is translatable (typically in a slidable manner) with respect to the base structure 2*a* along the longitudinal axis A1 of the central shaft 2. A second portion 2*c* is integral in translation with the first portion 2*b*. In other words, when the first portion 2*b* translates with respect to the base structure 2*a*, the second portion 2*c* translates together with the first portion 2*b*. Further to that, the second portion 2*c* is rotatable with respect to the base structure 2*a*, around the longitudinal axis A1 of the central shaft 2.

In view of the above, the second portion 2*c* can rotate with respect to the base structure 2*a* and, via the first portion 2*b*, it can also be translated with respect to the base structure 2*a*.

The movable portions 2*b*, 2*c* are moved by means of known means 4*a*, 4*b*, 4*c*. As an example, as in the shown embodiment, one or more jacks 4*a* are used to translate the first movable portion 2*b* with respect to the base structure 2*a*. The movable portion 2*c* is moved by a shaft motor 4*b* mounted on the central shaft 2 which drives a shaft gear 4*c*. The shaft gear 4*c* is rotated to cause a rotation of the second movable portion 2*c* with respect to the base structure 2*a*.

As discussed, the shown embodiment is only a possible embodiment of a central shaft 2 provided with movable portions 2*b*, 2*c*. As an example, more than two translatable and telescopically arranged portions may be provided, in order achieve a longer run along the longitudinal axis of the central shaft 2. Also, the shown embodiment provides a first portion 2*a* that provides translation with respect to the base structure 2*a*, and a second portion 2*c* that provides rotation with respect to the base structure 2*a*. In different embodiments, not shown in detail, a single movable portion may be provided that is both translatable and rotatable with respect to the base structure 2*a*.

In addition, embodiments are possible where no translation or no rotation are provided, i.e. embodiments comprising only movable portions of the central shaft that are translatable with respect to the base structure, and also embodiments only comprising movable portions that are rotatable with respect to the base structure of the central shaft.

Finally, an amusement device according to an embodiment of the present invention can be provided with a central shaft having no movable portions, i.e. with a central shaft that is substantially wholly integral with respect to the ground (or the surface to which the shaft is coupled).

A plurality of arms 3*a*, 3*b*, 3*c*, 3*d* are coupled to the central shaft 2. As mentioned, the central shaft is preferably provided with a plurality of movable portions 2*b*, 2*c*. The arms 3*a*-3*d* are thus preferably coupled to the movable portions 2*b*, 2*c* of the central shaft 2. According to an aspect, the arms 3*a*-3*d* are coupled to the portion 2*c* that is both translatable and rotatable with respect to the base structure 2*a*. In the shown embodiment, the arms 3*a*-3*d* are coupled to the second portion 2*c* that, as mentioned, is rotatable with respect to the base structure 2*a* and (thanks to the coupling with the first portion 2*b*) is also translatable along the longitudinal axis A1 of the central shaft 2.

Each arm 3*a*-3*d* is coupled to the central shaft 2 in a rotatable manner, around an arm axis A2, that is angled, preferably in a perpendicular manner, with respect to the longitudinal axis A1 of the central shaft 2. Preferably, all the arm axes A2 lie on the same plane. Each arm 3*a*-3*d* is typically coupled to the central shaft 2 by means of a shaft arm 5, that is arranged perpendicularly with respect to the central shaft 2.

The arms 3*a*-3*d* carry one or more vehicles 6, having a plurality of seats 6*a* for the users of the amusement device 1. The vehicles 6 are preferably placed at the ends 31, 32 of the arms 3*a*-3*d*. According to an aspect, the arms 3*a*-3*d* carry at least one vehicle 6 per each end 31, 32 of the arm. The ends 31, 32 of an arm 3*a*-3*d* are the two areas of the arms 3*a*-3*d* placed at the greatest distance from the relevant arm axis A2.

According to an aspect, the vehicles 6 are hinged to the arms 3*a*-3*d* so that the seats are maintained in a substantially vertical manner during operation of the amusement device 1, i.e. the users are not turned upside down during rotation of the arms 3*a*-3*d*. The number of arms 3*a*-3*d* may vary in different embodiments. Preferably, the amusement device 1 is provided with an even number of arms 3*a*-3*d*, more preferably four arms 3*a*-3*d*, as per the shown embodiment. Preferably, the angle between two subsequent arms is equal, i.e. the arms 3*a*-3*d* are angled with respect to each other at an angle that is substantially equal to 360°/n, where n is the number of arms. Such an angle is measured in plant view. In the shown embodiment, there are four arms, that are disposed at 90 degrees with respect to each other. According to an aspect, couples of opposite arms substantially share the same arm axes A2. As an example, in the shown (preferred) embodiment, there are four arms 3*a*-3*d*, and two arm axes A2. Arms 3*a* and 3*c* share the same arm axis. Similarly arms 3*b* and 3*d* share a second arm axis. Even if some of the arms 3*a*-3*d* share the same arm axis A2, the arm shafts 5 are distinct one from the other, i.e. there is a single and distinct arm shaft 5 for each arm 3*a*-3*d*. Due to this fact, there may be a minimum difference, due to tolerances, between the orientation arm axes A2 of opposite arms. However, such a minimum difference, due to previously mentioned tolerances, fall within the definition of "substantially sharing the same arm axis".

Opposite arms (such as arms 3*a* and 3*c*, or 3*b* and 3*d* of the shown embodiments) rotate in opposite direction, i.e. in a counterwise manner. In other words, the arm shafts 5 of opposite arms rotate in a counterwise manner. Thus, considering a common arm axis A2, one arm rotates in a clockwise manner, while the other opposite arm rotates in a counter-clockwise manner.

Figure 6A:
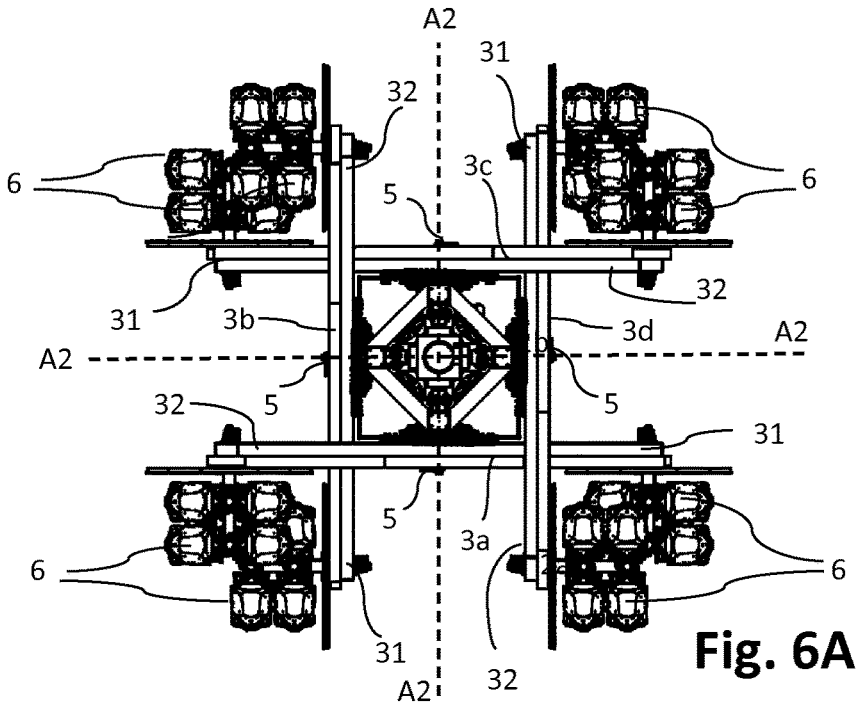
FIG. 6A is a top view of the amusement device of FIG. 1.
Figure 6B:
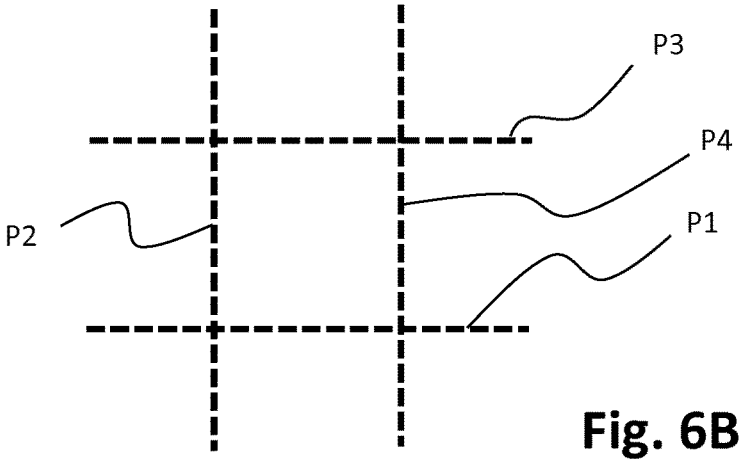
FIG. 6B is top view of the paths drawn by the ends of the arms of the amusement of FIG. 6A during its operation.

During rotation of the arms 3*a*-3*d*, the ends 31, 32 of each arm 3*a*-3*d* moves along a path P1-P4 (shown schematically in FIGS. 6B and 6C), typically a circular path. According to a preferred aspect, for each arm 3*a*-3*d*, the path P1-P4 of a first end of an arm intersects the path P1-P3 of an end of a different arm. The "intersection" should be understood in a broad manner. The paths P1-P4 can be drawn by joining the points that are touched by the ends of the arms. One path intersects another path not only when the line of the first path touches the line of the second path, but also when there is at least a common point (typically a common line) between the geometrical figure that is contained within the lines of the first path and of the second path.

In other words, a path of a first arm intersects with the path of a second arm, if there is at least one point of the space that, during use, is occupied (in different times) by both the first arm and the second arm.

Figure 6C:
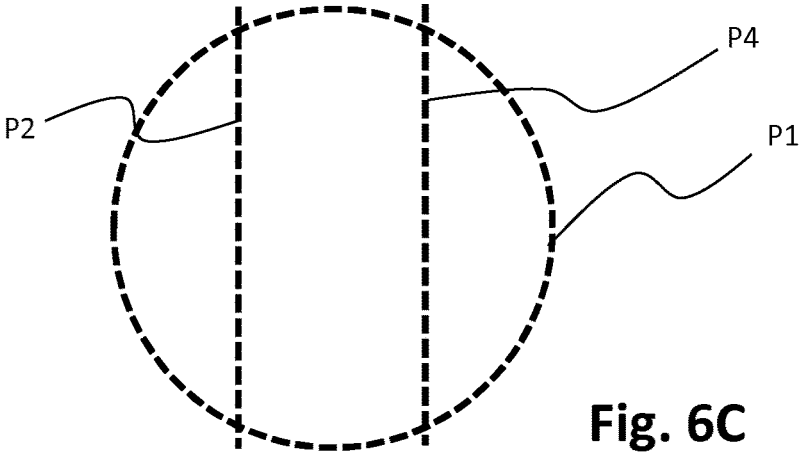
FIG. 6C is a front view of the paths of FIG. 6B.

Typically, the path of one end of each arm intersects with the path of two different arms. As an example, as schematically shown in FIG. 6C, the path P1 end 31 of the arm 3*a* intersects with the paths P2 and P3 of the ends of both arms 3*b* and 3*c*.

According to an aspect, the arms 3*a*-3*d* are substantially symmetrical with respect to the arm axis A2, so that the path of the two ends 31, 32 of the same arm 3*a*-3*d* coincide.

Preferably, for each arm 3*a*-3*d*, the path of the vehicle 6 of an arm intersects (i.e. overlaps) with the path of the vehicle 6 of a different arm. In view of the above, the path of two vehicles of different arm intersect if there is at least a point (typically a volume) of space that, during operation of the amusement device 1, is occupied, in different times, by both the vehicles. In other words, during operation of the amusement device, there is at least a position of a vehicle of an arm that was previously, at least partially, occupied by the vehicle of a different arm.

This provides to the user the feeling that the vehicle 6 of an arm 3*a*-3*d* (and in particular the vehicle on which he/she is seated) is going to collide with another vehicle 6 of a different arm 3*a*-3*d* of the amusement device. The amusement device 1 is however configured so that the arms 3*a*-3*d* never collide one with the other, i.e. the movements of the arms 3*a*-3*d* are synchronized to avoid collisions between the arms 3*a*-3*d*.

First of all, the arms 3*a*-3*d* are rotated at the same angular speed. In other words, at a given time, during operation of the amusement device 1, all the arms 3*a*-3*d* have the same angular speed. The angular speed of one arm may be varied over time. If this happens, all the other arms behave in a same manner. In other words, if at a given time arm 3*a* is rotated at a first angular speed, all the other arms 3*b*-3*d* are rotated at the same first angular speed. If, in a following moment, arm 3*a* is rotated at a second angular speed, e.g. greater than the first one, all the other arms 3*b*-3*d* are rotated at such a second angular speed.

The amusement device 1 comprises a gear system 7 to synchronize the movement (i.e. the rotation) of the arms 3*a*-3*d*.

The gear system 7 comprises a gear motor M and a plurality of gears 71-74*b*. In particular, the gear motor M is configured to rotate a first gear 71, that in turn rotates a plurality of second gears 72*a*-72*d*.

Figure 4:
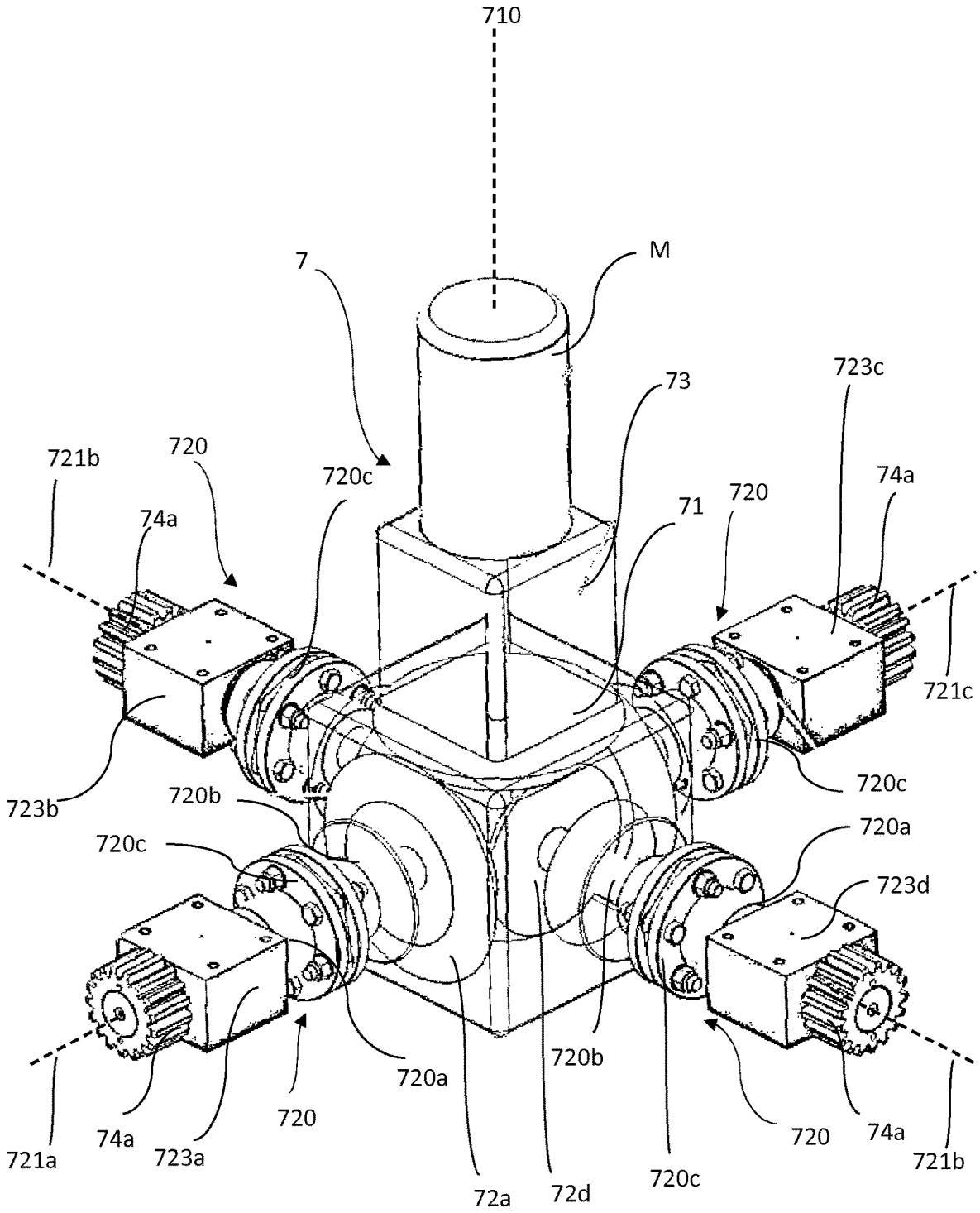
FIG. 4 is a schematic and perspective view of the gear system of FIG. 3.
Figure 5:
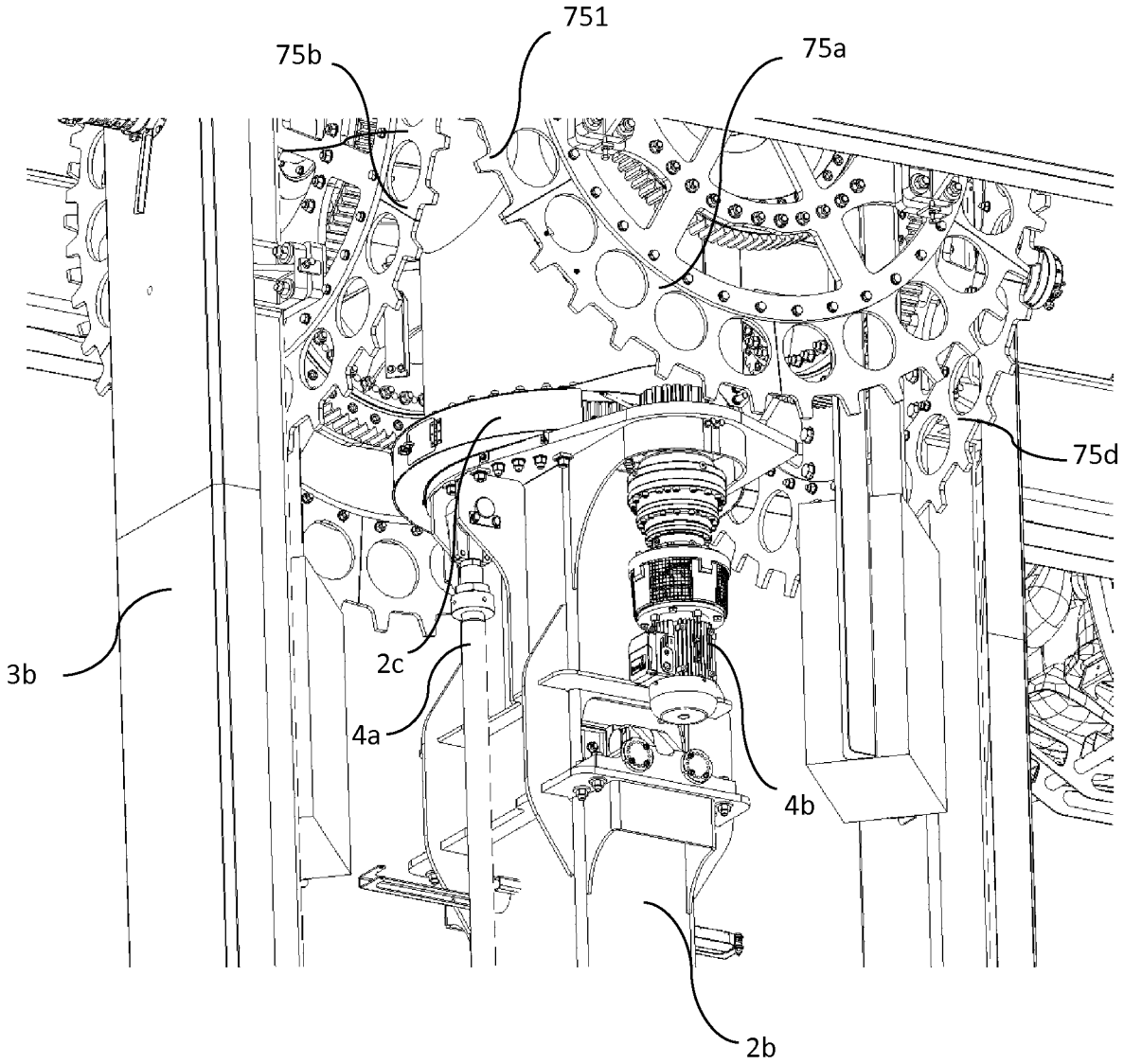
FIG. 5 is a perspective bottom view of a detail of the amusement device of FIG. 1, showing the movable portions of the shaft and the shaft motor.

The first gear 71 and the second gears 72*a*-72*d* are typically gear wheels. In the schematic view of FIG. 4, the tooth of the first gear 71 and of the second gears 72*a*-72 are not shown, for better clarity of the figure.

The gear motor M may be any known motor, in particular it may be an electric motor known in the art, that is configured to rotate a relevant drive shaft. The first gear 71 may be directly mounted on the drive shaft or, more preferably, as per the shown embodiment, it can be coupled to the gear motor M via a first reduction stage 73. In other words, the gear motor M drives the first reduction stage 73, that in turn drives the first gear 71.

The second gears 72*a*-72*d* are coupled to the arms 3*a*-3*d*, so that rotation of the second gears 72*a*-72 causes a rotation of the arms 3*a*-3*d*. As a result, there is a second gear 72*a*-72*d* for each of the arms 3*a*-3*d*. According to a possible embodiment, the second gears 72*a*-72*d* are coupled to a gear shaft that coincide with the arm shaft 5. However, according preferred embodiments, as the one shown in the figures, the second gears 72*a*-72*d* are coupled to gear shafts 720 that are distinct from the arm shafts 5.

Preferably, there is a second reduction stage 74*a*, 74*b* between the second gears 72*a*-72*d* and the arms shafts 5. In the shown embodiment, the second reduction stage 74*a*, 74*b* comprises, for each arm 5 of the arms 3*a*-3*d*, a first gear wheel 74*a* coupled to the gear shaft 720, that meshes with a relevant gear wheel 74*b* having greater diameter with respect to the first gear wheel 74*a*, and that is coupled to the arm shaft 5.

According to an aspect, the gear shafts 720 are not made in one piece; in fact, the gear shafts 720 preferably comprise at least two portions 720*a*, 720*b* that are coupled via a flexible joint 720*c*, known in the art, to reduce the loads on the gear shafts 720.

Preferably, the gear shafts 720 are supported by a frame 722 which, in a possible embodiment, has a substantially square shape, i.e. it has the shape of a substantially square picture shape. In other words, the frame 722 is provided with four plates arranged along the sides of a square. Preferably each gear shaft 720 is attached to said frame 722 by means of support blocks 723*a*, 723*b*, 723*c*, 723*d*.

According to an aspect, said support blocks 723*a*-723*d* are positioned in correspondence of the vertexes of shape defined by the frame 722.

The coupling between the gear shafts 720 and the frame 722 allows to assure that the relevant position between the gear shafts is maintained over time. As an example, in the shown embodiment, the gears shafts 720 are maintained, over time, substantially perpendicularly one to the other via the frame 722.

According to an aspect, the first gear 71 meshes directly with all the second gears 72*a*-72*d*, as shown in the figures. However, embodiments are possible where further secondary gears, preferably gear wheels, are placed between the first gear 71 and the second gears 72*a*-72*d*. As an example, the first gear 71 may mesh with a secondary gear, that in turn meshes with the second gears 72*a*-72*d*.

Preferably, the first gear 71 rotates around a first gear axis 710 that is perpendicular to the second gear axes 721*a*-721*d* (that are the axes around which the second gears 72*a*-72*d* rotate). Typically, the first gear axis 710 is parallel (and preferably substantially coincident) with the longitudinal axis A1 of the central shaft 2, while the second gear axes 721*a*-721*d* are substantially parallel to the arm axes A2. Preferably, the second gear axes 721*a*-721*d* lie on the same plane. Preferably, the gear motor M, the first gear 71 and the second gears 72*a*-72*d* are coupled to the central shaft 2, preferably at a portion of the first shaft 2 that is distal with respect to the base structure 2*a*.

As mentioned, the central shaft 2 is typically provided with one or more movable portions 2*b*, 2*c*. The motor M, the first gear 71 and the second gears 72*a*-72*d* are thus preferably coupled to a movable portion 2*c* of the central shaft 2.

It has to be noted that the gear motor M is a distinct and independent element with respect to the means that move the movable portions 2*b*, 2*c* of the central shaft 2 with respect to the base portion.

According to a preferred embodiment, shown in the figures, the amusement device 1 is provided with a plurality of safety gear 75*a*-75*d*. In more detail, a preferred embodiment is provided with a safety gear 75*a*-75*d* for each arm 3*a*-3*d*.

The safety gears 75*a*-75*d* are configured so that, when all the arms 3*a*-3*d* are driven by the gear motor M, the safety gears 75*a*-75*d* are disengaged from one another, and they do not touch each other. In other words, none of the safety gears drives another safety gear. In case of a failure, at least a first safety gear 75*a*-75*d* is coupled to a second safety gear 75*a*-75*d*, so that a second safety gear may drive the first safety gear. Preferably, the safety gears are mounted onto the arm shafts 5, so that they rotate together with the arm shafts 5. In particular, at least during a failure, more preferably in all the operating conditions of the amusement device 1, the rotation of the safety gears 75*a*-75*d* is integral with the rotation of the arms 3*a*-3*d* around the relevant arm axes A2. Thus, in case of a failure, e.g. a mechanical failure in the gear system 7, one or more safety gears 75*a*-75*d* may be coupled to a different safety gear 75*a*-75*d*, so that the synchronization of the arm shafts 5 is not lost.

According to a preferred aspect, the safety gears 75*a*-75*d* are provided with teeth 751 that are arrange so that, during normal operation of the amusement device 1, the teeth 751 of a safety gear 75*a*-75*d* do not mesh with the teeth of another safety gear 75*a*-75*d*, while they are brought into contact in case of need. Preferably, during normal operation of the amusement device 1, the teeth of a safety gear 75*a*-75*d* pass within the space between subsequent teeth 751 of at least another gear 75*a*-75*d*, without touching them. In such an embodiment, the space between subsequent teeth is greater than the width of the teeth 751.

Figure 7A:
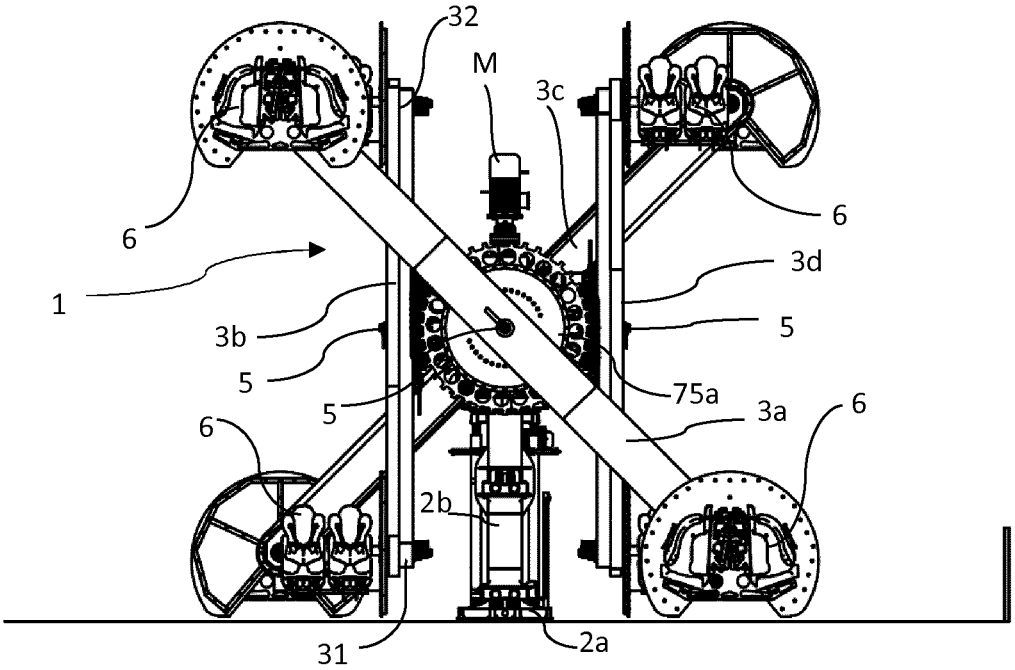
FIG. 7A is a front view of the amusement device of FIG. 1 during its operation, in particular when the translatable portion of the shaft is lowered with respect to the base structure.

In use, the amusement device 1 is placed in a loading position, to allow the users of the amusement device 1 to embark on the vehicles 6 (and possibly to allow the users of the previous ride to disembark the vehicle 6). As discussed, the central shaft 2 is preferably provided with a translatable portion 2*b*. In a first step the movable portion 2*b* is translated, e.g. by means of one or more jacks 4*a*, with respect to the base structure 2*a*, moving the vehicles towards the ground, or to a relevant external surface/platform. As mentioned, the central shaft 2 is typically arranged (in use) in a vertical position, so that in this step the movable portion 2*b* is lowered along the vertical direction. The arms 3*a*-3*d* are rotated until one of the ends 31, 32 of each arm 3*a*-3*d* comes close to the ground/platform on which the users are waiting, allowing the embarking/disembarking of users on/from the at least one vehicle 6, and preferably at least one vehicle 6 of each arm 3*a*-3*d* is placed in a position allowing the users to embark such a vehicle. According to an aspect, in the above discussed loading/unloading position, the arms 3*a*-3*d* can be angled with respect to the horizontal (i.e. it has an angle greater than 0° and less than 90°), to allow different users to embark on vehicles placed on different arms. Preferably, the arms 3*a*-3*d* form an angle of about 45° with respect to the horizontal, as shown in FIG. 7A. As discussed, in the condition shown in FIG. 7, the users can be loaded on vehicles of all the arms, i.e. on one vehicle of all the arms, i.e. to the vehicles 6 that are placed at the level or the ground.

Typically, after this step, only the vehicles placed at one end 31, 32 of the arms 3*a*-3*d* are loaded with users.

Thus, in a following step, the arms 3*a*-3*d* are rotated, typically by 180°, allowing the users to be loaded also in the remaining vehicles, placed at the oppose ends of the arms with respect to the ones that were loaded in the preceding step.

Preferably, to carry out this step, the movable portion 2*b* is first raised to allow rotation of the arms, and then lowered again to allow embarking of the users, in a manner similar to the previously discussed step.

A different embodiment of the present invention may e.g. provide raised platform arranged laterally to the amusement device 1, allowing the users to embark/disembark on an amusement device 1 that is not provided with a translatable portion 2*b*.

Also, it is not excluded that the users are loaded in more than two steps, e.g. because the amusement device 1 is provided with a plurality of arms, or because the arms 3*a*-3*d* are placed in subsequent angular position that do not allow the user to embark on vehicles of all the arms of the amusement device 1.

In any case, preferred embodiments of the invention, as the one shown in the figure, allow to embark/disembark the users in only two steps, a first steps where part of the users are loaded on the vehicles of a first end 31, 32 of all the arms 3*a*-3*d*, and a second step where the remaining users are loaded in all the remaining vehicles 6, i.e. the vehicles placed at the opposite end with respect to the ones of the first step.

Figure 7B:
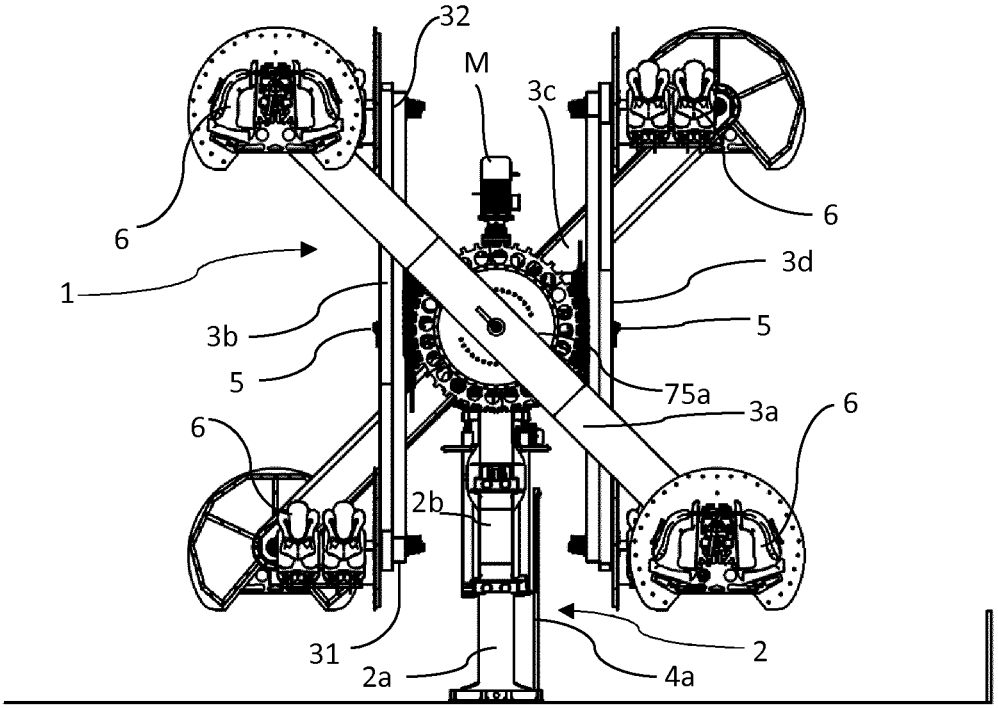
FIG. 7B is a front view of the embodiment of FIG. 7A during its operation, in particular when the translatable portion of the shaft is raised with respect to the base structure.
Figure 7C:
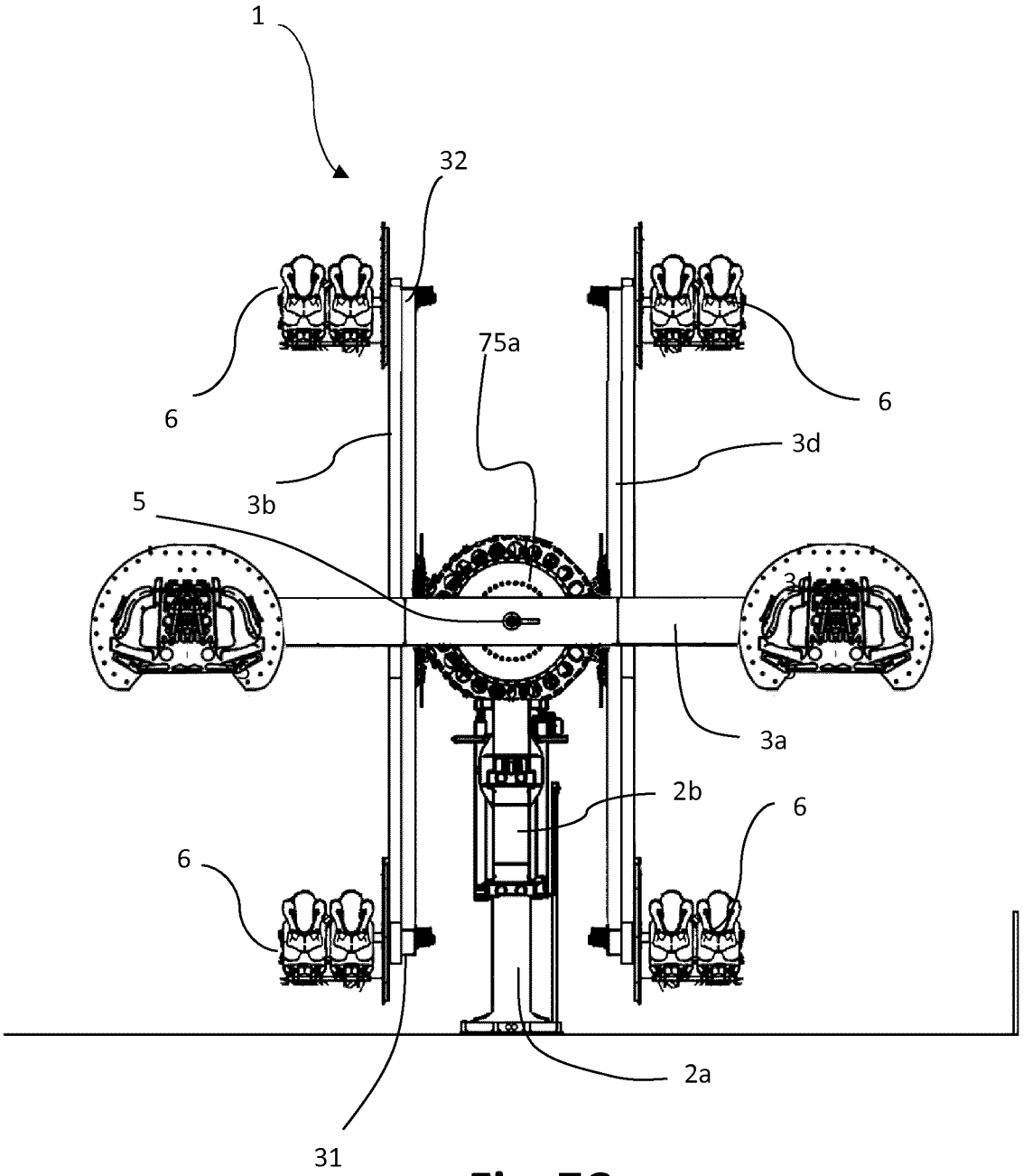
FIG. 7C is a front view of the amusement device of FIG. 7A according to the invention during its operation.

At the end of the loading/unloading, i.e. when all the users are loaded/unloaded on/from the vehicles 6, the gear motor M is operated to cause rotation of the arms 3*a*-3*d*, in order to start the ride of the amusement device 1. Preferably, the movable portion 2*b* is translated with respect to the base structure 2*a*, typically is raised along the longitudinal axis A1 of the central shaft, as shown in FIG. 7B.

During operation of the amusement device 1, the movable portions 2*b*, 2*c* of the central shaft 2 can be moved with respect to the base structure 2*a*, to improve the feeling of the users. As an example, the rotatable portion 2*c* can be rotated, e.g. via the shaft motor 4*b* to cause the rotation of the vehicles around the central axis A1 of the central shaft 2. in addition, or as an alternative, the translatable portion 2*b* can be translated along the central axis A1 of the central shaft 2.

As above discussed, the arms 3*a*-3*d* are rotated by the gear system 7 which allows to synchronize the movement of the arms 3*a*-3*d*.

In particular, according to a preferred embodiment, the gear motor M is configured to rotate a first gear 71, that in turn rotates a plurality of second gears 72*a*-72*d* which are coupled to the respective gear shafts 720, which in turn are coupled to the arms 3*a*-3*d*, so that rotation of the second gears 72*a*-72 causes a rotation of the arms 3*a*-3*d*.

Typically, adjacent arms (such as arms 3*a* and 3*b*, or 3*b* and 3*c* of the shown embodiments) rotate in opposite direction, i.e. in a counterwise manner. Also, if the amusement device 1 is provided with arms that are opposite one to the other, i.e. if the amusement device 1 is provided with one or more couples of arms 3*a*-3*d* sharing a common arm axis A2, the arms rotate in opposite direction with respect to such a common axis (such as arms 3*a* and 3*d*, or 3*b* and 3*d* of the shown embodiments) one arm rotates in a clockwise manner, while the other opposite arm rotate in a counterclockwise manner with respect to such a common arm axis A2.

During rotation, the ends 31, 32 and relative vehicles 6 of each arm 3*a*-3*d* moves along a path, typically a circular path. According to a preferred aspect, for each arm, the path of a first end of an arm intersects the path of an end of a different arm, according to the meaning of the "intersection" above discussed.

Thanks to the gear system 7, the arms 3*a*-3*d* never collide one with the other, i.e. the movements of the arms 3*a*-3*d* are synchronized to avoid collisions and harm to the users of the amusement device 1.

At the end of the ride, the shaft motor 4*b* is stopped and the unloading operation takes place, in a manner similar to what was disclosed for the loading step, i.e. by placing the vehicles 6 in subsequent steps near to the ground, or to a relevant platform.

In case of malfunctioning, safety gears 75*a*-75*d* are preferably provided to maintain the synchronization of the rotation of arms 3*a*-3*d* around the relevant arm axes A2. As an example, considering the safety gear 75*a*, during normal operation of the amusement device 1, the safety gear 75*a* is disengaged from the other safety gears 75*b*-75*d*. Preferably, teeth 751 of safety gear 75*a* are disengaged from (i.e. do not mesh with) the teeth 751 of safety gears 75*a*-75*d*, e.g. they pass between the spaces of the teeth 751 of safety gears 75*b* and 75*d*, without touching them. As a result, in this condition, the safety gears 75*a*-75*d* do not provide a particular effect.

However, in case of malfunctioning, an arm 3*a*-3*d* may no more be rotated by the gear motor M, e.g. due to wear of the relevant second gear. For easiness of description, it will be now be discussed malfunctioning of the arm 3*a*, but the following discussion applies to the other arms 3*b*-3*d* as well.

In particular, if e.g. there is an excessive wear of the second gear 72*a*, the arm 3*a* may not be rotated by the gear motor M. Without the safety gears 75*a*-75, the arm 3*a* would crash against arm 3*b* and/or arm 3*c*. On the contrary, thanks to the present solution, the safety gear 75*a*, in first (very short) moment, i.e. when the malfunctioning occurs, loses its synchronization with the other safety gears 75*b*-75*c*. In particular, with reference to the shown preferred embodiment, the teeth of the safety gear 75*a* do not fall anymore within the space between the teeth 751 of the safety gears 75*b* and 75*c*, but the they contact the teeth of the safety gears 75*b* and/or 75*c*. As a consequence, the safety gear 75*a* meshes with the safety gear 75*b* and/or with the safety gear 75*c*, according to the sense of rotation of the gear system 7.

More in general, the safety gear 75*a* is driven in rotation by safety gear 75*b* and/or safety gear 75*c*.

As a consequence, the arm 3*a* is still rotated by the gear system 7 via the coupling (e.g. via relevant meshing) of the safety gear 75*a* with safety gears 75*b* and 75*c*, even if the coupling between the first gear 71 and the second gear 72*a* is broken.

It should be noted that the safety gears 75*a*-75*d* may compensate for even more than one failure in the gear system. As an example, only one arm may be properly coupled to the motor M, and the amusement device would still operate in a substantial proper manner. As an example, second gear 72*a*-72*c* may be broken, so that only second gear 72*d* is still rotatably coupled to the first gear 71. Even in this case, the relevant safety gear 75*d* would drive safety gears 75*b* and 75*c* that, in turn, would drive the last safety gear 75*a*, allowing the amusement device 1 to continue its run.

Finally, it may be the case that none of the second gears 72*a*-72*d* is properly coupled to the motor, e.g. due to a break in the first gear 71. Even in this case, the safety gears 75*a*-75*d* assure a synchronization of the movement of the relevant arms 3*a*-3*d*. In fact, the motor M would drive none of the arms 3*a*-3*d*. As a result, all the safety gears 75*a*-75*d* are coupled, continuing the run of the arms 3*a*-3*d* due to inertia, until they stop. As above discussed, meshing of the safety gears 75*a*-75*d* assure synchronization of the arms 3*a*-3*d*, for the whole time of rotation of the arms 3*a*-3*d*, avoiding collisions between the vehicles 6 of the amusement device 1.

The invention claimed is:

1. Amusement device (1) comprising:

a central shaft (2) comprising a base structure (2*a*);

a plurality of arms (3*a*, 3*b*, 3*c*, 3*d*), coupled to said central shaft (2), each of said arms (3*a*-3*d*) being rotatable around a relevant arm axis (A2), provided with one or more vehicles (6) having seats for users of said amusement device (1);

a gear system (7) for rotating said plurality of arms (3*a*-3*d*), the gear system (7) comprising:

a gear motor (M) coupled to a first gear (71), to rotate said first gear (71);

a plurality of second gears (72*a*, 72*b*, 72*c*, 72*d*), one for each arm (3*a*, 3*b*, 3*c*, 3*d*) of said plurality of arms, coupled to said first gear (71) so that rotation of the first gear (71) drives in rotation said second gears (72*a*-72*d*), the rotation of said second gears (72*a*-72*d*) causing rotation of each arm (3*a*-3*d*) around the relevant arm axis;

wherein the gear system (7) is configured so that the angular speed of said arms (3*a*-3*d*) is substantially identical for all the arms;

wherein said first gear (71) is directly meshing with said second gears (72*a*-72*d*), or said first gear (71) is coupled to said second gears (72*a*-72*d*), wherein each of said arms (3*a*-3*d*) is provided with a safety gear (75*a*-75*d*), configured so that:

when each of said arms (3*a*-3*d*) is driven by the gear motor (M), the safety gear (75*a*-75*d*) of an arm (3*a*-3*d*) is disengaged from the safety gears (75*a*-75*d*) of the other arms (75*a*-75*d*), when there is a failure, and at least one of the arms (3*a*-3*d*) is not driven by the gear motor (M), the safety gear (3*a*-3*d*) of an arm (3*a*-3*d*) that is not driven by the gear motor (M) couples with at least one safety gear (75*a*-75*d*) of another arm (3*a*-3*d*).

2. Amusement device according to claim 1, wherein said central shaft (2) comprises one or more movable portions (2*b*, 2*c*), that are movable with respect to said base structure (2*a*).

3. Amusement device according to claim 2, wherein said gear motor (M) is a distinct and independent element with respect to means (4, 4*b*, 4*c*) that move said one or more movable portions (2*b*, 2*c*) of the central shaft (2) with respect to the base structure (2*a*).

4. Amusement device (1) according to claim 3, wherein said gear motor (M), said first gear (71) and said second gears (72*a*-72*d*) are mounted on one of said movable portions (2*b*, 2*c*) of said shaft (2).

5. Amusement device according to claim 2, wherein said central shaft (2) comprises a portion (2*c*) that is rotatable with respect to said base structure (2*a*).

6. Amusement device (1) according to claim 5, comprising a shaft motor (4*b*) to rotate said portion (2*c*), said shaft motor (4*b*) being distinct from said gear motor (M).

7. Amusement device according to claim 2, wherein said central shaft (2) comprises a portion (2*b*) that is translatable with respect to said base structure (2*a*), along a longitudinal axis (A1) of said central shaft (2).

8. Amusement device (1) according to claim 1, wherein the rotation of the arms (3*a*, 3*b*, 3*c*, 3*d*) is operated independently from a rotation of one or more movable portions (2*c*) of the shaft with respect to the base structure (2*a*).

9. Amusement device (1) according to claim 1 configured so that for each arm (3*a*-3*d*), the path of one of the ends (31, 32) of said arm (3*a*-3*d*) intersects the path of at least one end (31, 32) of another arm (3*a*-3*d*), and wherein the gear system (7) is configured to avoid collisions of said arms (3*a*-3*d*).

10. Amusement device (1) according to claim 1, wherein said first gear (71) is rotatable around a first gear axis (710) and the second gears (72*a*-72*d*) are rotatable around second gears axes (721*a*-721*d*), the first gear axis (710) being perpendicular with respect to the second gear axes (721*a*-721*d*).

11. Amusement device (1) according to claim 1, wherein each of said second gears (72*a*-72*d*) is coupled to a gear shaft (720), said arms (3*a*-3*d*) being coupled to arm shafts (5) that are driven in rotation by, and parallel to, said gear shaft (720).

12. Amusement device (1) according to claim 1, having an even number of arms, so that a pair of opposite arms (3*a*-3*c*; 3*b*-3*d*) rotates around the same arm axis (A2), along opposite direction with respect to said arm axis (A2).

13. Amusement device (1) according to claim 1, wherein a first reduction stage (73) is interposed between said gear motor (M) and said first gear (71).

14. Amusement device (1) according to claim 1, wherein a second reduction stage (74*a*, 74*b*) is interposed between the second gears (72*a*-72*d*) and each of said arms (3*a*-3*d*) around the relevant arm axis.

15. Method of operation of an amusement device (1) according to claim 1, comprising rotating the arms (3*a*-3*d*) via gear motor (M), and moving at least one movable portion (2*b*, 2*c*) of the central shaft (2) with respect to the base structure (2*a*) of the central shaft (2).

16. Method according to claim 15, wherein the at least one movable portion (2*a*, 2*b*) comprises, a translatable portion (2*b*), the method comprising translating the translatable portion (2*b*) that is translated with respect to said base structure.

17. Method according to claim 15, wherein the at least one movable portion (2*a*, 2*b*) comprises a rotatable portion (2*c*), the method comprising rotating the rotatable portion (2*c*) with respect to said base structure.

18. Method of operation of an amusement device (1) according to claim 1, wherein each of said arms (3*a*-3*d*) is provided with a safety gear (75*a*-75*d*), and:

when each arm of said arms (3*a*-3*d*) is driven by the gear motor (M), the method comprises disengaging the safety gear (75*a*-75*d*) of an arm (3*a*-3*d*) from the safety gears (75*a*-75*d*) of the other arms (75*a*-75*d*), when there is a failure, and at least one of the arms (3*a*-3*d*) is not driven by the gear motor (M), the method comprises coupling the safety gear (75*a*-75*d*) of an arm (3*a*-3*d*) that is not driven by the gear motor (M) with at least one safety gear (75*a*-75*d*) of another arm.

19. Amusement device (1) according to claim 1, wherein said one or more vehicles (6) are arranged at both the ends (31, 32) of said arms (3*a*-3*d*).

20. Amusement device (1) according to claim 12 wherein said number of even arms is four.

21. Amusement device (1) according to claim 1, further comprising secondary gears placed between the first gear (71) and the second gears (72*a*, 72*d*).

22. Amusement device (1) comprising:

a central shaft (2) comprising a base structure (2*a*);

a plurality of arms (3*a*, 3*b*, 3*c*, 3*d*), coupled to said central shaft (2), each of said arms (3*a*-3*d*) being rotatable around a relevant arm axis (A2), provided with one or more vehicles (6) having seats for users of said amusement device (1);

a gear system (7) for rotating said plurality of arms (3*a*-3*d*), the gear system (7) comprising:

a gear motor (M) coupled to a first gear (71), to rotate said first gear (71);

a plurality of second gears (72*a*, 72*b*, 72*c*, 72*d*), one for each arm (3*a*, 3*b*, 3*c*, 3*d*) of said plurality of arms, coupled to said first gear (71) so that rotation of the first gear (71) drives in rotation said second gears (72*a*-72*d*), the rotation of said second gears (72*a*-72*d*) causing rotation of each arm (3*a*-3*d*) around the relevant arm axis;

wherein the gear system (7) is configured so that the angular speed of said arms (3*a*-3*d*) is substantially identical for all the arms;

wherein said first gear (71) is directly meshing with said second gears (72*a*-72*d*), or said first gear (71) is coupled to said second gears (72*a*-72*d*), wherein a first reduction stage (73) is interposed between said gear motor (M) and said first gear (71).

23. Amusement device (1) comprising:

a central shaft (2) comprising a base structure (2*a*);

a plurality of arms (3*a*, 3*b*, 3*c*, 3*d*), coupled to said central shaft (2), each of said arms (3*a*-3*d*) being rotatable around a relevant arm axis (A2), provided with one or more vehicles (6) having seats for users of said amusement device (1);

a gear system (7) for rotating said plurality of arms (3*a*-3*d*), the gear system (7) comprising:

a gear motor (M) coupled to a first gear (71), to rotate said first gear (71);

a plurality of second gears (72*a*, 72*b*, 72*c*, 72*d*), one for each arm (3*a*, 3*b*, 3*c*, 3*d*) of said plurality of arms, coupled to said first gear (71) so that rotation of the first gear (71) drives in rotation said second gears (72*a*-72*d*), the rotation of said second gears (72*a*-72*d*) causing rotation of each arm (3*a*-3*d*) around the relevant arm axis;

wherein the gear system (7) is configured so that the angular speed of said arms (3*a*-3*d*) is substantially identical for all the arms;

wherein said first gear (71) is directly meshing with said second gears (72*a*-72*d*), or said first gear (71) is coupled to said second gears (72*a*-72*d*), wherein said central shaft (2) comprises one or more movable portions (2*b*, 2*c*), that are movable with respect to said base structure (2*a*), wherein said central shaft (2) comprises a portion (2*c*) that is rotatable with respect to said base structure (2*a*) and comprises a shaft motor (4*b*) to rotate said portion (2*c*), said shaft motor (4*b*) being distinct from said gear motor (M).

24. Amusement device (1) comprising:

a central shaft (2) comprising a base structure (2*a*);

a plurality of arms (3*a*, 3*b*, 3*c*, 3*d*), coupled to said central shaft (2), each of said arms (3*a*-3*d*) being rotatable around a relevant arm axis (A2), provided with one or more vehicles (6) having seats for users of said amusement device (1);

a gear system (7) for rotating said plurality of arms (3*a*-3*d*), the gear system (7) comprising:

a gear motor (M) coupled to a first gear (71), to rotate said first gear (71);

a plurality of second gears (72*a*, 72*b*, 72*c*, 72*d*), one for each arm (3*a*, 3*b*, 3*c*, 3*d*) of said plurality of arms, coupled to said first gear (71) so that rotation of the first gear (71) drives in rotation said second gears (72*a*-72*d*), the rotation of said second gears (72*a*-72*d*) causing rotation of each arm (3*a*-3*d*) around the relevant arm axis;

wherein the gear system (7) is configured so that the angular speed of said arms (3*a*-3*d*) is substantially identical for all the arms;

wherein said first gear (71) is directly meshing with said second gears (72*a*-72*d*), or said first gear (71) is coupled to said second gears (72*a*-72*d*), wherein said central shaft (2) comprises one or more movable portions (2*b*, 2*c*), that are movable with respect to said base structure (2*a*), wherein said central shaft (2) comprises a portion (2*b*) that is translatable with respect to said base structure (2*a*), along a longitudinal axis (A1) of said central shaft (2).

25. Amusement device (1) comprising:

a central shaft (2) comprising a base structure (2*a*);

a plurality of arms (3*a*, 3*b*, 3*c*, 3*d*), coupled to said central shaft (2), each of said arms (3*a*-3*d*) being rotatable around a relevant arm axis (A2), provided with one or more vehicles (6) having seats for users of said amusement device (1);

a gear system (7) for rotating said plurality of arms (3*a*-3*d*), the gear system (7) comprising:

a gear motor (M) coupled to a first gear (71), to rotate said first gear (71);

a plurality of second gears (72*a*, 72*b*, 72*c*, 72*d*), one for each arm (3*a*, 3*b*, 3*c*, 3*d*) of said plurality of arms, coupled to said first gear (71) so that rotation of the first gear (71) drives in rotation said second gears (72*a*-72*d*), the rotation of said second gears (72*a*-72*d*) causing rotation of each arm (3*a*-3*d*) around the relevant arm axis;

wherein the gear system (7) is configured so that the angular speed of said arms (3*a*-3*d*) is substantially identical for all the arms;

wherein said first gear (71) is directly meshing with said second gears (72*a*-72*d*), or said first gear (71) is coupled to said second gears (72*a*-72*d*), wherein said central shaft (2) comprises one or more movable portions (2*b*, 2*c*), that are movable with respect to said base structure (2*a*), and wherein said gear motor (M), said first gear (71) and said second gears (72*a*-72*d*) are mounted on one of said movable portions (2*b*, 2*c*) of said shaft (2).

* * * * *